United States Patent [19]

Autorino et al.

[11] Patent Number: 4,871,169

[45] Date of Patent: Oct. 3, 1989

[54] GAME BALL

[76] Inventors: Joseph A. Autorino; Jeffrey P. Crouch, both of 170 Brittany Farms Rd., New Britain, Conn. 06053

[21] Appl. No.: 260,119

[22] Filed: Oct. 20, 1988

[51] Int. Cl.[4] ..... A63B 37/14

[52] U.S. Cl. ..... 273/26 R; 273/60 B; 273/58 K

[58] Field of Search ..... 273/26 R, 60 R, 60 A, 273/60 B, 58 B, 58 BA, 58 A, 58 D, 58 E, 58 F, 58 G, DIG. 20

[56] References Cited

U.S. PATENT DOCUMENTS

| | | | |
|---|---|---|---|
| 2,625,399 | 1/1953 | Steinhardt | 273/60 B |
| 2,814,159 | 11/1957 | Green | 273/58 K |
| 3,740,036 | 6/1973 | Ames | 273/128 A |
| 3,843,129 | 10/1974 | Dietrich | 273/128 A |
| 4,128,238 | 12/1978 | Newcomb et al. | 273/58 K |
| 4,616,828 | 10/1986 | Haythornthwaite | 273/58 K |
| 4,641,839 | 2/1987 | Turner | 273/128 A |

*Primary Examiner*—George J. Marlo

*Attorney, Agent, or Firm*—McCormick, Paulding & Huber

[57] ABSTRACT

Two hemispherical ball components are joined to permit one to be rotated relative to the other. Each component not only defines the ball's spherical surface but also defines a "flat" minor spherical segment. By manually manipulating the flat on one component relative that on the other one can provide any number of trick throws or pitches to confuse a batter.

14 Claims, 1 Drawing Sheet

GAME BALL

This invention relates generally to balls of the type adapted to be thrown in games such as the popular Whiffleball game made possible by providing a one piece spherical ball with holes or openings in one half and with a non-perforated skin in the other half.

In addition to the Whiffleball applicant is aware of a prior art ball shown and described in U.S. Pat. No. 4,128,238 issued to Newcomb et al. This patent shows a spherical ball having a flat surface on one side to facilitate curving of the ball when it is thrown. In both the patented ball and the Whiffleball no provision is made for varying the external configuration of the spherical ball surface to facilitate a greater degree of control over this curving action when the ball is thrown.

The aim of the present invention is to provide an improved game ball having some characteristics of the prior art Newcomb baseball but also having characteristics of the conventional Whiffleball and further including the capability for varying the geometrical configuration of the ball itself to give the pitcher or thrower a greater degree of control over the flight of his curve ball, screw ball, slider, and/or other trick pitch.

In accordance with the present invention a game ball is provided having two generally hemispherically shaped ball components, and means is provided for coupling these components to one another so that the ball has a major spherically shaped smooth external surface that is defined in part on each hemisphere and that also includes a minor spherical surface segment that is not smooth, but has a configuration that creates an aerodynamic effect markedly different from that on the major spherical surface of the ball.

The means for coupling the ball components preferably comprises ball and socket portions defined in part by each of the two ball components. Each component also has a generally flat face adapted to mate with a similar flat face on the other ball component such that when joined the overall appearance is like that of a conventional circular ball. The minor surface segment may be roughened or otherwise textured to achieve a significantly different aerodynamic drag or resistance than the spherical surface. In addition this minor surface segment is defined in part by each of the two ball components so that one can rotate one ball component relative to the other in order to create a different flight path for the ball as it is thrown depending upon the degree of rotation of the one ball component relative to the other.

DETAILED DESCRIPTION

Figure 1:
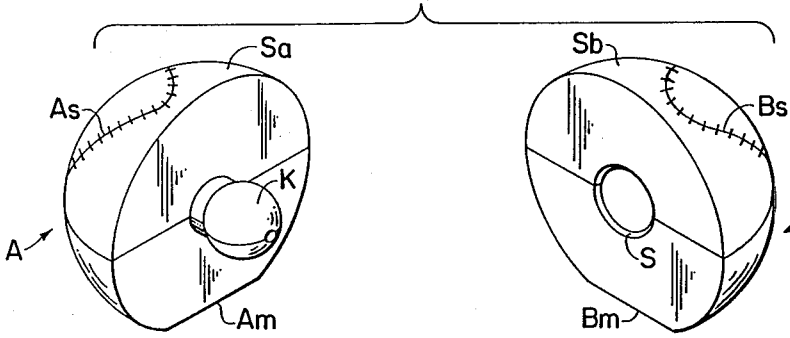
FIG. 1 is a perspective view of the two ball components that are adapted to be coupled to one another in a manner such that one ball component can be rotated relative to the other.
Figure 4:
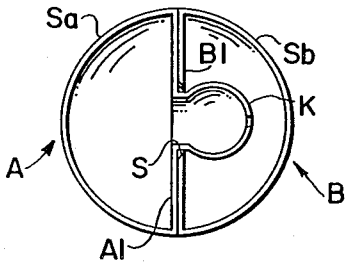
FIG. 4 is a sectional view taken generally on the line 4—4 of FIG. 2.

Turning now to the drawings in greater detail, FIG. 1 shows two generally hemispherically shaped components A and B, which components are adapted to be assembled with one another by snapping one into the other (A into B) as suggested in FIG. 4 to provide a generally spherically shaped external surface (Sa and Sb) made up of the major hemispherical surfaces of the components A and B respectively.

As shown in FIG. 1 each ball component, A and B, not only defines the major hemispherically shaped surface Sa and Sb, but also defines a minor spherical surface segment Am and Bm respectively.

Figure 2:
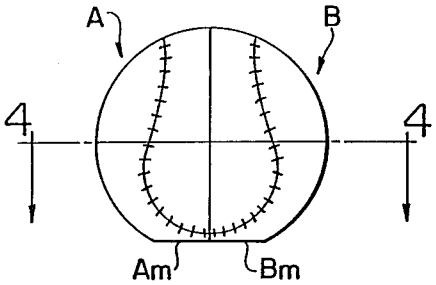
FIG. 2 is a view of the ball components of FIG. 1 coupled to one another so as to provide a flat surface at the bottom of the ball.
Figure 3:
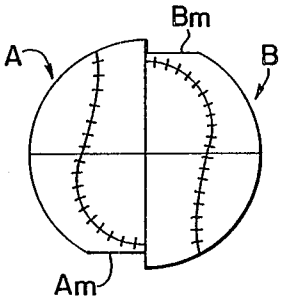
FIG. 3 is a view similar to FIG. 2 but shows on flat rotated through 180 degrees relative to the flat defined on the other ball component.
Figure 5:
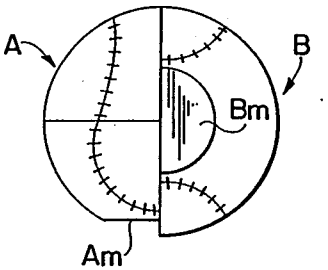
FIG. 5 is a view of the ball of FIGS. 2 and 3, but with the flat on the right-hand ball component rotated through only 90 degrees relative to the flat on the other ball component.

As shown in the drawings these minor spherical segment surfaces Am and Bm can be aligned with one another as suggested in FIG. 2, or otherwise oriented with respect to one another by rotating one ball component B relative to the other ball component A so as to provide these surfaces Am and Bm in spaced angular relationship with respect to one another. FIG. 3 shows these surfaces Am and Bm rotated 180 degrees relative to one another, and FIG. 5 shows these surfaces Am and Bm rotated 90 degrees relative to one another.

Although the surfaces Am and Bm are shown with a radius of curvature considerably larger than that of the spherical external ball surfaces generally (and in fact shows such surfaces as virtually flat) it will be apparent that other configurations for these surfaces might also be provided in the two ball components. For example, the purpose of the present invention is to provide a "trick" ball that will perform marked undulations in its flight as it is thrown for example by a pitcher to a batter. Therefore, it will be apparent that as long as the minor surface segment (Am and Bm) is such as to create a aerodynamic effect markedly different from that of the major spherical surface area (Sa and Sb) the advantages of the present invention can be realized.

In the preferred embodiment illustrated in the drawings the surfaces Sa and Sb may include simulated stitching As and Bs but this is optional and serves only to simulate as nearly as possible the configuration of a conventional baseball. It is in accordance with the present invention to provide a game ball with a completely smooth hemispherical major surface as defined by the ball components at Sa and Sb. It will be apparent from the drawings that the minor spherical surface segment (Am and Bm) are virtually or nearly flat, that is they have a radius of curvature of close to infinity. It will also be apparent that other configurations for these "flats" can be provided for within the scope of the present invention. For example these surface segments Am and Bm might be formed with a rougher texture then is true of the major spherical surfaces Sa and Sb. The important feature of such surfaces is that they create an aerodynamic effect markedly different from that of the major spherical surface area.

Turning now to a more detailed description of the means for coupling the ba II components A and B to one another it will be apparent from FIG. 1 that ball component A has an integrally defined knob K, which knob is adapted to be received in an opening or socket S in ball component B. In fact, ball component B can be formed in the same mold as used to injection blow mold ball component A with the further step being take n that the knob K be cut away to provide the opening S for receiving the knob to the other ball component. Other methods of fabricating a ball in accordance with the present invention might also be devised. For example a dumbbell shaped coupling means might be adapted to join two ball components similar to that illustrated at the right-hand side of FIG. 1 namely ball component B. Thus, a two piece ball is shown in FIG. 1 but as long as at least two generally hemispherically shaped ball components can be rotated one relative to another the ball itself might be fabricated in any number of parts.

As best shown in FIG. 4 the ball and more particularly the ball components are molded from a sturdy plastic material and have generally flat mating surfaces A1 and B1 and It Ia on these surfaces that the knob and socket shaped coupling means are defined in part on one ball component A and in part on the other ball component B. Once assembled these ball components A and B are adapted to permit rotation of the one relative to the other so as to achieve a desired geometrical configuration for the "flats" Am and Bm all as mentioned previously.

I claim:

1. A game ball comprising two generally hemispherically shaped components, means movably coupling said components to one another such that the ball has a generally spherically shaped external surface, one or both of said ball components defining said generally spherically shaped surface also defining a minor spherical surface segment thereof, said minor surface segment having a configuration such that it creates an aerodynamic effect markedly different from that of the major spherical surface area of the ball and the ball will perform marked undulations in its flight when thrown.

2. The ball of claim 1 wherein said coupling means comprises knob and socket mean defined in part by each of said two components.

3. The ball of claim 1 wherein said coupling means provides for rotation of one of said two ball components relative to the other of said two ball components.

4. The ball of claim 1 wherein said minor surface segment is defined in part by one of said two ball components and in part by the other of said two ball components.

5. The ball of claim 1 wherein said minor surface segment is defined in part by one of said two ball components and in part by the other of said two ball components, wherein said coupling means comprises knob and socket means defined in part by each of said two components.

6. The ball of claim 1 wherein said minor surface segment is defined in part by one of said two ball components and in part by the other of said two ball components, wherein said coupling means provides for rotation of one of said two ball components relative to the other of said two ball components.

7. The ball of claim 1 wherein said minor surface segment is defined in part by one of said two ball components and in part by the other of said two ball components, wherein said coupling means provides for rotation of one of said two ball components relative to the other of said two ball components and wherein said rotation is impeded by friction within said means coupling said components, said rotation being achieved manually prior to throwing the ball.

8. The ball of claim 1 wherein said minor surface segment is defined in part by one of said two ball components and in part by the other of said two ball components, wherein said coupling means provides for rotation of one of said two ball components relative to the other of said two ball components and wherein said rotation is impeded by friction within said means coupling said components, said rotation being achieved manually prior to throwing the ball, wherein said coupling means comprises knob and socket means defined in part by each of said two components.

9. The ball of claim 1 wherein said minor surface segment is defined in part by one of said two ball components and in part by the other of said two ball components, wherein said coupling means provides for rotation of one of said two ball components relative to the other of said two ball component and wherein said rotation is impeded by friction within said means coupling said components, said rotation being achieved manually prior to throwing the ball, wherein said coupling means comprises knob and socket means defined in part by each of said two components, said minor surface segment has a larger radius of curvature than that of said spherical external ball surface generally.

10. The ball of claim 4 wherein said ball components are molded from a plastic material and have generally flat mating surfaces that define knob and socket shaped coupling means adapted to provide for angular rotational adjustment to one of said two components relative to the other.

11. The ball of claim 10 wherein said minor spherical surface segment is defined in part by one of said two ball components and in part by the other of said two ball components.

12. The ball of claim 11 wherein said minor spherical segment has a larger radius of curvature then that of said spherical external ball surface generally.

13. The ball of claim 12 wherein said angular rotational adjustment is accomplished about an axis generally perpendicular said generally flat mating surfaces.

14. The ball of claim 13 wherein said axis passes through the spherical center of said external ball surface.

* * * * *